US011578448B2

(12) United States Patent
Chiorino et al.

(10) Patent No.: US 11,578,448 B2
(45) Date of Patent: Feb. 14, 2023

(54) COLOR SENSOR FOR WASHING MACHINES

(71) Applicant: Whirlpool Corporation, Benton Harbor, MI (US)

(72) Inventors: Carlo Chiorino, Buguggiate (IT); Luca Sorana, Gualdo Tadino (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/363,362

(22) Filed: Jun. 30, 2021

(65) Prior Publication Data

US 2022/0042232 A1 Feb. 10, 2022

Related U.S. Application Data

(60) Provisional application No. 63/062,797, filed on Aug. 7, 2020.

(51) Int. Cl.
*D06F 34/18* (2020.01)

(52) U.S. Cl.
CPC ..... *D06F 34/18* (2020.02)

(58) Field of Classification Search
CPC ..... D06F 34/18
See application file for complete search history.

(56) References Cited

U.S. PATENT DOCUMENTS

| | | | |
|---|---|---|---|
| 8,215,136 B2 | 7/2012 | Kim et al. | |
| 2005/0257573 A1 | 11/2005 | Henssler et al. | |
| 2006/0075578 A1* | 4/2006 | Hellhake | D06F 33/34 8/158 |
| 2018/0171525 A1 | 6/2018 | Lv et al. | |
| 2019/0093276 A1 | 3/2019 | Hombroek | |

FOREIGN PATENT DOCUMENTS

| | | | |
|---|---|---|---|
| CN | 2451623 | Y | 10/2001 |
| CN | 201128826 | Y | 10/2008 |
| CN | 202369811 | U | 8/2012 |
| CN | 205576529 | U | 9/2016 |
| CN | 108729127 | A | 11/2018 |
| CN | 108914479 | A | 11/2018 |
| CN | 209296565 | U | 8/2019 |
| CN | 110373856 | A | 10/2019 |
| DE | 10355457 | A1 | 6/2005 |
| EP | 2035613 | B1 | 8/2018 |
| EP | 3571454 | A1 | 11/2019 |
| JP | 2000-093685 | A | 4/2000 |
| KR | 20010088209 | A | 9/2001 |
| KR | 20190012613 | A | 2/2019 |
| WO | WO-2008000812 | A1 | 1/2008 |

OTHER PUBLICATIONS

CA Search report from corresponding European App No. EP21188634 dated Dec. 17, 2021.

* cited by examiner

*Primary Examiner* — Jason Y Ko
(74) *Attorney, Agent, or Firm* — Harness, Dickey & Pierce PLC

(57) ABSTRACT

A laundry washing machine includes a housing with conventional washing elements within the housing. A door on a door opening of the housing enables access inside the housing to the conventional washing elements. A sensor senses color of cloth prior to passing the cloth through the door opening. The sensor is positioned so that it senses the cloth in a dedicated area outside of the machine adjacent to the door or door opening.

15 Claims, 1 Drawing Sheet

COLOR SENSOR FOR WASHING MACHINES

CROSS-REFERENCE TO RELATED APPLICATION

This application claims the benefit of U.S. Provisional Application No. 63/062,797, filed on Aug. 7, 2020. The entire disclosure of the above application is incorporated herein by reference.

FIELD

The present disclosure relates to laundry washing machines and, more particularly, to a washing machine including a sensor identifying the cloth color prior to passing the cloth into the washing machine.

BACKGROUND

This section provides background information related to the present disclosure which is not necessarily prior art.

When washing clothes, it is desirable to process loads of the same color. Accordingly, white clothes are washed with white clothes and colored clothes are washed with colored clothes. If washing occurs with a mixed loads, different colors, this may reduce the washing effectiveness and damage the clothes. One example can be a misplaced colored cloth between an all-white load. Here, depending upon the washing cycle selected, the color can be transferred to the white clothes. Another example can be the mistaken selection of a high temperature washing cycle for an all colored load. The washing cycle may impact the clothes color. Further, the sorting of laundry by color is very difficult or impossible for users with a partial or complete blindness disability.

Accordingly, this disclosure overcomes the disadvantages of the prior art. This is done by sensing the color of the cloth outside of the washing machine prior to passage of the cloth into the washing machine. Additionally, a control system can identify the color of the cloth and confirm that it can be washed with the selected washing programs. Also, it is possible that the control system will deny washing if a selected washing program does not correspond to the cloth color.

SUMMARY

Accordingly to an object of the disclosure, a laundry washing machine comprises a housing or cabinet with conventional washing elements, such as a drum and tub assembly, inside the housing or cabinet. A door is positioned at a door opening of the housing. The door and opening enable access inside of the housing to the conventional washing elements, drum and tub assembly. A sensor is positioned to sense color of the cloth prior to passing the cloth through the door opening. The sensor is positioned so that the sensor senses the cloth in a dedicated area outside of the washing machine adjacent the door opening. The sensor is capable of reading the color of the cloth. Further included is a control system that identifies color of the cloth and confirms the cloth can be washed in a selected program.

Accordingly to another object of the disclosure, a laundry washing machine for presorting clothes based on color comprises a housing with conventional washing elements within the housing. A door on a door opening of the housing. The door opening enables access inside the housing to the conventional washing elements. A sensor senses color of cloth. The sensor is positioned so that it senses the cloth in a dedicated area outside of the washing machine to enable a user to sort the cloth based on color. The sensor is capable of reading color of the cloth. The sensor sensing color of the cloth positioned on the housing. The sensor sensing the color of the cloth is positioned on the door. An alarm indicates the color of the cloth to enable sorting of the cloth by color. The alarm signal is audible, visual or haptic or combinations thereof.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
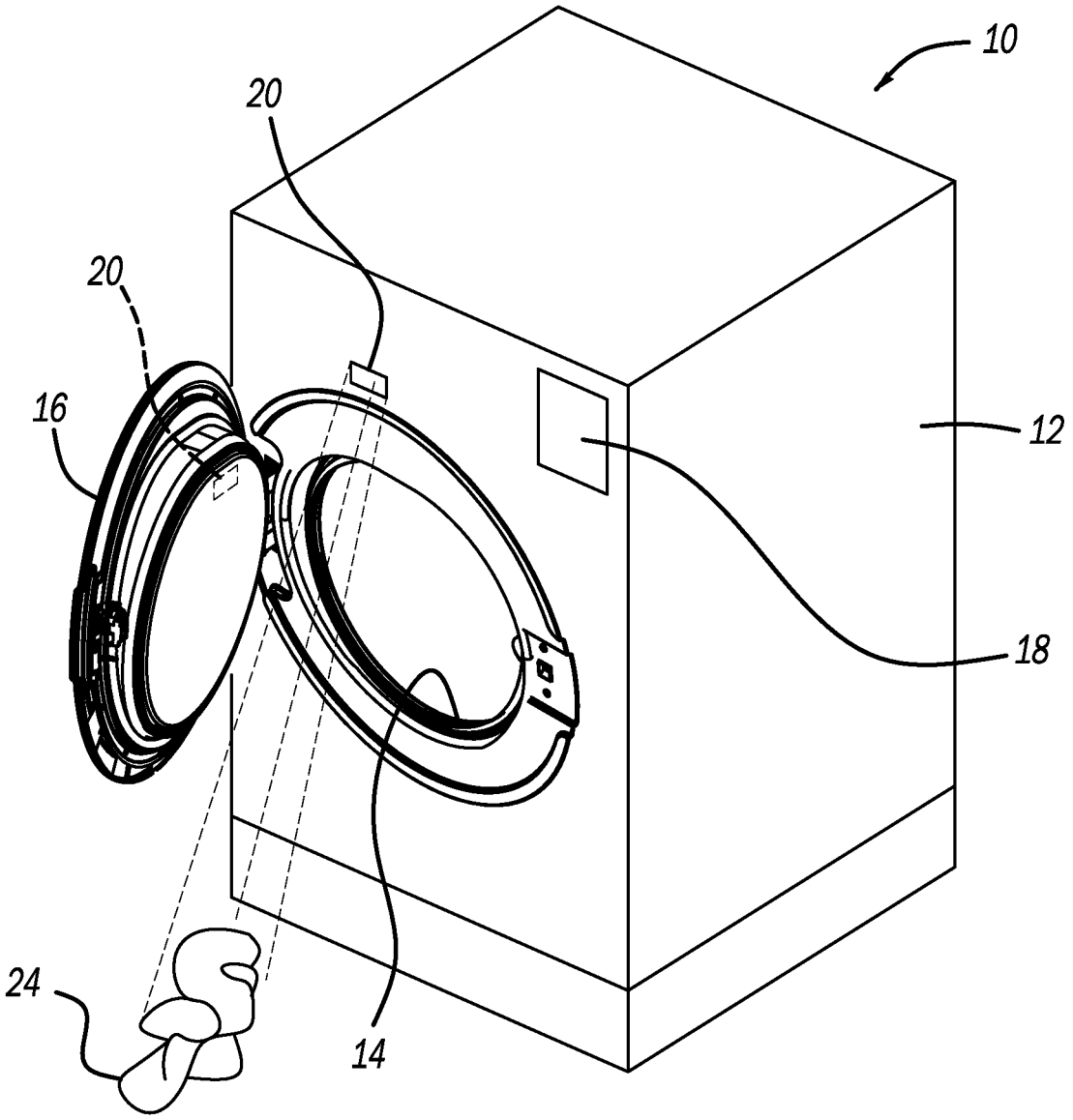
FIG. 1 is a perspective schematic view of a washing machine.
Figure 2:
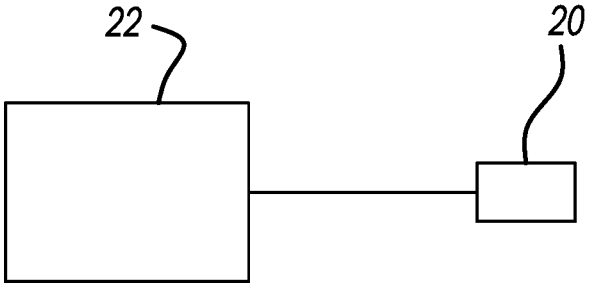
FIG. 2 is a schematic view of a controller.

Example embodiments will now be described more fully with reference to the accompanying drawings.

Turning to the figures, a laundry washing machine is illustrated and designated with the reference numeral 10. The laundry washing machine 10 includes a housing or cabinet 12 that houses conventional components of a laundry washing machine, such as a drum and tub assembly. The housing 12 includes a door opening 14 to enable access inside of the housing 12 to the conventional components. A door 16 is mounted to the housing and covers the opening 14 when the laundry washing machine 10 is in an operational condition. A control panel 18 is associated with the housing 12 to enable programming of the washing machine 10 for a load that is placed into the washing machine drum and tub assembly.

A sensor 20 may be positioned on the housing 12. The sensor 20 is electrically coupled with a controller 22. The controller 22 is like that utilized for washing clothes. The sensor 20 is capable of reading the color of cloth 24 positioned outside of the housing 12 adjacent the door opening 14. The sensor 20 senses the color of the cloth 24 prior to entry of the cloth 24 into the washing machine 10. Thus, the color is sensed prior to passage through the door opening 14. The sensing of the color of the cloth 24 takes place in a dedicated area generally in front of the washing machine near the door opening 14. Thus, a user with a vision impairment is aware of the color of the cloth prior to the cloth being placed into the drum and tub assembly.

Also, the sensor 20 could be positioned anywhere on the door 16, housing 12 or frame such that it is capable of reading the color of the cloth 24 prior to entry into the laundry machine 10. The sensor 20 could be positioned on the inside of the door 16 so that when the door is open, the sensor 20 would be able to read the color of the cloth 24 prior to passage into the washing machine 10.

The controller 22 would include a dedicated control system coupled with the sensor 20. The system would be capable of identifying the color of the cloth. Once the color of the cloth is determined by the control system, the control system can determine if the colored cloth is able to be washed in the preselected washing program. If the colored cloth is able to be washed in the preselected washing program, then the controller will enable the load to be washed. If the control system senses that the color of the cloth is incapable of being washed in the preselected washing program, then the controller may set off an alarm indicating the color of the cloth is not compatible with the selected program. Thus, the controller would deny the selected washing program with the sensed cloth. The alarm may be an audible, visual, haptic signal or combinations of the signals.

Alternatively, since the sensor 20 and system determine the color the cloth prior to entering the washing machine, the cloth can be presorted outside of the machine. This enables colored loads and white loads to be prepared for washing during a presorting operation. The system could provide an alarm indicating the color of the cloth to ensure proper presorting. Thus, this ensures that like colors are washed together.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A laundry washing machine, comprising:

a housing with a drum and tub assembly within the housing;

a door on a door opening of the housing, the door opening enabling access inside the housing;

a sensor for sensing color of cloth prior to passing the cloth through the door opening, the sensor positioned so that the sensor senses the color of the cloth in a dedicated adjacent to the door or door opening;

a controller electrically coupled with the sensor, the controller including a control system that is programmed to identify color of the cloth and determine if the cloth is compatible to be washed in a preselected washing program; and an alarm indicating a color cloth has been added to the drum and tub assembly.

2. The laundry washing machine of claim 1, wherein the sensor for sensing color of the cloth is positioned on the housing.

3. The laundry washing machine of claim 1, wherein the sensor for sensing color of the cloth is positioned on the door.

4. The laundry washing machine of claim 1, wherein the alarm is audible, visual or haptic or combinations thereof.

5. The laundry washing machine of claim 1, wherein the sensor of the colored doth enables sorting of clothes prior to washing.

6. A laundry washing machine for presorting clothes based on color, comprising:

a housing with a drum and tub assembly within the housing;

a door received in a door opening of the housing, the door opening enabling access inside the housing;

a sensor for sensing color of cloth, the sensor positioned so that the sensor senses the color of the cloth in a dedicated area outside of the washing machine to enable a user to sort the cloth based on color;

a controller electrically coupled with the sensor, the controller including a control system that is programmed to identify color of the cloth and determine if the cloth is compatible to be washed in a preselected washing program; and an alarm indicating a color of the cloth to enable sorting of the cloth by color.

7. The laundry washing machine for presorting clothes based on color of claim 6, wherein the sensor for sensing color of the cloth is positioned on the housing.

8. The laundry washing machine for presorting clothes based on color of claim 6, wherein the sensor for sensing color of the cloth is positioned on the door.

9. The laundry washing machine for presorting clothes based on color of claim 6, wherein the alarm is audible, visual or haptic or combinations thereof.

10. The laundry washing machine of claim 1, wherein the control system of the controller includes memory that is programmed to enable the selected washing program when the doth is compatible to be washed in the preselected washing program.

11. The laundry washing machine of claim 1, wherein the control system of the controller includes memory that is programmed to deny the selected washing program when the cloth is not compatible to be washed in the preselected washing program.

12. The laundry washing machine of claim 1, wherein the control system is programmed to activate the alarm when the color of the cloth is not compatible to be washed in the preselected washing program.

13. The laundry washing machine for presorting clothes based on color of claim 6, wherein the control system of the controller includes memory that is programmed to enable the selected washing program when the cloth is compatible to be washed in the preselected washing program.

14. The laundry washing machine for presorting clothes based on color of claim 6, wherein the control system of the controller includes memory that is programmed to deny the selected washing program when the cloth is not compatible to be washed in the preselected washing program.

15. The laundry washing machine for presorting clothes based on color of claim 6, wherein the control system is programmed to activate the alarm when the color of the cloth is not compatible to be washed in the preselected washing program.

* * * * *